US009452906B2

(12) United States Patent
Heckendorff

(10) Patent No.: US 9,452,906 B2
(45) Date of Patent: Sep. 27, 2016

(54) WINDING DEVICE FOR WINDING UP AT LEAST ONE MATERIAL TO BE WOUND ONTO AT LEAST ONE EXCHANGEABLE TUBE

(71) Applicant: Dietze & Schell Maschinenfabrik GmbH & Co. KG, Coburg (DE)

(72) Inventor: Andreas Heckendorff, Ahorn (DE)

(73) Assignee: Dietze & Schell Maschinenfabrik GmbH & Co. KG, Coburg (DE)

( * ) Notice: Subject to any disclaimer, the term of this patent is extended or adjusted under 35 U.S.C. 154(b) by 134 days.

(21) Appl. No.: 14/338,726

(22) Filed: Jul. 23, 2014

(65) Prior Publication Data

US 2015/0175372 A1 Jun. 25, 2015

(30) Foreign Application Priority Data

Dec. 19, 2013 (DE) ..... 20 2013 105 818 U

(51) Int. Cl.

| | |
|---|---|
| ***B65H 18/20*** | (2006.01) |
| ***B65H 19/22*** | (2006.01) |
| ***B65H 54/553*** | (2006.01) |
| ***B65H 67/04*** | (2006.01) |
| ***B65H 75/24*** | (2006.01) |
| ***B65H 19/30*** | (2006.01) |
| ***B65H 18/02*** | (2006.01) |
| ***B65H 18/10*** | (2006.01) |

(52) U.S. Cl.

CPC ..... *B65H 19/22* (2013.01); *B65H 18/028* (2013.01); *B65H 18/10* (2013.01); *B65H 19/305* (2013.01); *B65H 54/553* (2013.01); *B65H 67/0405* (2013.01); *B65H 75/241* (2013.01); *B65H 2301/4181* (2013.01); *B65H 2301/41346* (2013.01); *B65H 2511/12* (2013.01); *B65H 2701/31* (2013.01)

(58) Field of Classification Search

CPC ..... B65H 19/305; B65H 2405/422; B65H 19/2292

USPC ..... 242/530.4, 533.1–533.2, 0.5, 242/533.7–533.8, 559.3

See application file for complete search history.

(56) References Cited

U.S. PATENT DOCUMENTS

| | | | | |
|---|---|---|---|---|
| 4,988,052 A * | 1/1991 | Urban | ..... | B65H 19/2284 242/524.1 |
| 6,016,987 A | 1/2000 | Kohnen | | |
| 7,896,283 B2 * | 3/2011 | Tauber | ..... | B65H 19/22 242/530.1 |

FOREIGN PATENT DOCUMENTS

| | | |
|---|---|---|
| EP | 0327048 A2 | 8/1989 |
| EP | 0887297 A2 | 12/1998 |
| GB | 221690 A | 11/1989 |
| WO | 0200539 A1 | 1/2002 |

OTHER PUBLICATIONS

Extended European Search Report issued on Jun. 10, 2015 in the corresponding EP application No. 14196555.8.

* cited by examiner

*Primary Examiner* — Sang Kim
(74) *Attorney, Agent, or Firm* — Posz Law Group, PLC

(57) ABSTRACT

A winding device for winding up at least one material to be wound onto at least one exchangeable tube, having at least one winding mandrel which is provided to receive the at least one tube in at least one operating state and/or drive it in rotation about a winding axis, comprising at least one winding mandrel has a first mandrel unit and at least one second mandrel unit, wherein the mandrel units are introducible from opposite sides into the at least one tube.

15 Claims, 3 Drawing Sheets

WINDING DEVICE FOR WINDING UP AT LEAST ONE MATERIAL TO BE WOUND ONTO AT LEAST ONE EXCHANGEABLE TUBE

CROSS REFERENCE TO RELATED APPLICATION

This application is based on and incorporates herein by reference German Patent Application No. 20 2013 105 818 filed on Dec. 19, 2013.

PRIOR ART

The invention relates to a winding device according to the preamble of claim 1.

A winding device having a one-piece winding mandrel for holding an exchangeable tube for winding up a material to be wound onto the tube has already been proposed.

The objective of the invention is in particular to provide a generic winding device having improved properties with regard to a working speed and/or operability. According to the invention, the objective is achieved by way of the features of claim 1, while advantageous embodiments and developments of the invention can be gathered from the dependent claims.

Advantages of the Invention

The invention proceeds from a winding device for winding up at least one material to be wound onto at least one exchangeable tube, having at least one winding mandrel which, in at least one operating state, is provided to receive the at least one tube and/or drive it in rotation about a winding axis.

It is proposed that the at least one winding mandrel has a first mandrel unit and at least one second mandrel unit, wherein the mandrel units are introducible from opposite sides into the at least one tube. A "material to be wound" should be understood in this context as meaning a material which is able to be wound up in particular for storage and/or for transport. For example, the at least one material to be wound can be at least one windable material made of plastics material and/or metal and/or textile fiber and/or paper. A "tube" should be understood in this context as meaning in particular a body which is provided to receive a material to be wound up, in particular on an outer surface which is convexly curved preferably at least partially and particularly advantageously entirely. Preferably, the at least one tube is configured at least partially as a hollow body, advantageously as a hollow cylinder, in particular having an annular base surface. The term "provided" should be understood as meaning in particular specifically programmed and/or designed and/or equipped. The fact that an object is provided for a particular function should be understood as meaning in particular that the object fulfills and/or executes this particular function in at least one use state and/or operating state. The fact that the at least one tube is "exchangeable" should be understood in this context as meaning in particular that, in particular after an in particular predetermined quantity of the at least one material to be wound has been wound up, the at least one tube is replaceable with a further empty tube that is different from the at least one tube. A "winding mandrel" should be understood in this context as meaning in particular a rotatable unit which is provided to transmit its rotary movement and/or a torque to a tube located on the winding mandrel. Preferably, the at least one winding mandrel is configured at least partially as a clamping mandrel which engages in the at least one tube and transmits a rotary movement and/or a torque to the at least one tube by means of a cohesive connection and/or by means of a form fit and/or preferably by means of a force fit, in particular by means of at least one clamping jaw. A "winding axis" should be understood in this context as meaning in particular an axis about which a rotation of the at least one winding mandrel and/or of the at least one tube is executable in particular in order to wind up the at least one material to be wound. A "mandrel unit" should be understood in this context as meaning in particular a unit which forms at least a part of the at least one winding mandrel. Preferably, the one first mandrel unit and the at least one second mandrel unit are formed separately from one another. In particular when use is made of tubes having a large width, at least one further mandrel unit can be arranged between the one first mandrel unit and the at least one second mandrel unit, in particular in order to stabilize the tube during a winding-up operation. The fact that the one first mandrel unit and the at least one second mandrel unit "are introducible from opposite sides into the at least one tube" should be understood in this context as meaning in particular that the one first mandrel unit and the at least one second mandrel unit are movable, in particular at least substantially along the winding axis, in opposite directions into the at least one tube. The one first mandrel unit and the at least one second mandrel unit form the at least one winding mandrel in a state in which they have been introduced at least substantially fully into the at least one tube. Preferably, in the state in which they have been introduced at least substantially fully into the at least one tube, the one first mandrel unit and/or the at least one second mandrel unit are connectible to the at least one tube cohesively and/or in a form-fitting manner and/or preferably in a force-fitting manner, in particular via a retention force between two components, preferably by way of a frictional force between the components.

As a result of the configuration according to the invention, a winding device having improved properties with regard to a working speed and/or operability, in particular handling of tubes, can be provided. In particular, as a result of the at least one winding mandrel being embodied with a first mandrel unit and at least one second mandrel unit, advantageously easy and/or rapid and/or precise placing of tubes on the at least one winding mandrel can be made possible. Furthermore, as a result of the mandrel units being inserted from both sides into the at least one tube, advantageously uncomplicated changing between tubes of different widths can be made possible, with the result that in particular a changeover time can advantageously be minimized.

In a preferred configuration of the invention, it is proposed that a distance between the first mandrel unit and the at least one second mandrel unit is variable in a manner parallel and/or perpendicular to the winding axis. Preferably, the at least one second mandrel units is mounted such that it is movable relative to the one first mandrel unit. In particular, the at least one second mandrel unit is displaceable along a straight line, which extends parallel to the winding axis, relative to the one first mandrel unit, and/or is pivotable relative to the one first mandrel unit, wherein a pivot axis extends parallel to the winding axis. As a result, advantageously easy placing of the at least one tube in particular on the one first mandrel unit can be made possible. Furthermore, advantageously uncomplicated introduction of the one first mandrel unit and/or of the at least one second mandrel unit into the at least one tube can be achieved.

Advantageously, the winding device comprises a drive unit which is operatively connected to the one first mandrel unit. A "drive unit" should be understood in this context as meaning in particular a unit which is provided to generate a rotary movement and/or a torque. Preferably, the one drive unit has at least one motor, preferably an electric motor, for generating the rotary movement and/or the torque. The drive unit is advantageously coupled to the one first mandrel unit such that the rotary movement generated by the drive unit and/or the torque generated by the drive unit is transmissible to the at least one mandrel unit directly and/or indirectly, for example via a transmission and/or a belt drive and/or chain drive. As a result, the one first mandrel unit and/or a tube placed on the one first mandrel unit can be set into a rotary movement in an advantageously simple manner. Furthermore, it is proposed that the at least one second mandrel unit is drivable via the at least one tube. Preferably, to this end, the one first mandrel unit and the at least one second mandrel unit are in a state in which they have been introduced into the at least one tube and connected to the latter in a cohesive and/or form-fitting and/or preferably force-fitting manner. The fact that the at least one second mandrel unit is "drivable" via the at least one tube should be understood in this context as meaning in particular that a rotary movement transmitted to the at least one tube by the one first mandrel unit and/or a torque transmitted to the at least one tube by the one first mandrel unit is transmissible at least partially and preferably fully to the at least one second mandrel unit via the at least one tube. As a result, a rotary movement and/or a torque can advantageously be transmitted to the at least one second mandrel unit. Furthermore, a drive unit for actively driving the at least one second mandrel unit can advantageously be eliminated. Moreover, operational reliability can be improved, since in particular friction and/or vibrations can be minimized.

In a further preferred configuration of the invention, it is proposed that the first mandrel unit and the at least one second mandrel unit are arranged in a manner spaced apart from one another at least during one winding-up operation and preferably during each winding-up operation. A "winding-up operation" should be understood in this context as meaning in particular an operation during which the at least one material to be wound is wound up onto the at least one tube by the winding device. The expression "arranged in a manner spaced apart from one another" should be understood in this context as meaning in particular that, in particular when the mandrel units have been introduced fully into the at least one tube, there is a distance of at least 2 mm, advantageously of at least 5 mm and particularly advantageously of at least 10 mm between an end side of the one first mandrel unit and an end side of the at least one second mandrel unit. As a result, full introduction of the one first mandrel unit and of the at least one second mandrel unit into the at least one tube can be advantageously reliably ensured. Furthermore, precise positioning and/or secure clamping of the at least one tube can be achieved in a simple and/or reliable manner.

Furthermore, it is proposed that the winding device has at least one tube-changing unit which is provided to feed the at least one tube to the first mandrel unit and/or to transport said tube away from the first mandrel unit. In particular, the at least one tube-changing unit is provided to guide tubes in particular automatically and/or at least semi-automatically to the one first mandrel unit and/or to place the at least one tube automatically and/or semi-automatically onto the one first mandrel unit. Furthermore, the at least one tube-changing unit is preferably provided to remove the at least one tube from the one first mandrel unit, in particular following a winding-up operation, and/or to make the at least one tube available to be transported away. As a result, advantageously automated changing of tubes and thus an advantageously continuous material flow can be made possible.

Advantageously, the at least one tube-changing unit comprises at least one first handling unit which is provided to place empty tubes on the first mandrel unit. A "handling unit" should be understood in this context as meaning in particular a unit which brings about, within the winding device, a material flow, in particular a flow of tubes, to the one mandrel unit and/or away from the one mandrel unit. Preferably, the at least one first handling unit operates automatically and/or at least semi-automatically. Furthermore, the at least one first handling unit is in particular provided to place an empty tube on the one first mandrel unit before a winding-up operation. As a result, an advantageously rapid and/or reliable feed of empty tubes to the one first mandrel unit can be achieved.

In a further preferred configuration of the invention, it is proposed that the at least one tube-changing unit comprises at least one second handling unit which is provided to remove loaded tubes from the first mandrel unit. A "loaded tube" should be understood in this context as meaning in particular a tube to which a predetermined quantity of the at least one material to be wound has been applied during a winding-up operation. The at least one second handling unit is in particular provided to release a loaded tube from the first mandrel unit and/or withdraw it therefrom following completion of the winding-up operation. Preferably, the at least one second handling unit is furthermore provided to make loaded tubes available to be automatically and/or manually transported away. As a result, advantageously rapid and/or easy transporting away of loaded tubes can be achieved.

Preferably, the at least one second handling unit is formed at least partially in one piece with the at least one second mandrel unit. The fact that two units are formed "partially in one piece" should be understood as meaning in particular that the units have at least one common element which is in particular a functionally important constituent part of both units. In particular, the at least one second mandrel unit is provided to transmit a tensile force from the at least one handling unit to the loaded tube to be removed during the withdrawal of a loaded tube from the one first mandrel unit. To this end, the at least one second mandrel unit is in the state in which it has been introduced at least partially and preferably at least substantially fully into the loaded tube and connected thereto in particular in a cohesive and/or form-fitting and/or preferably force-fitting manner, in particular by way of clamping jaws. As a result, the at least one second mandrel unit can additionally be used to remove loaded tubes from the one first mandrel unit, with the result that additional components can advantageously be eliminated.

Moreover, it is proposed that the at least one first handling unit and/or the at least one second handling unit is movable parallel to the winding axis and/or is pivotable about an axis parallel to the winding axis. In particular, a movement of the at least one first handling unit serves to place the at least one tube onto the first mandrel unit. A pivoting movement of the at least one second handling unit serves in particular to set down loaded tubes in particular for further transport. As a result, an advantageously continuous flow of tubes can be achieved. In particular this may make it possible for setting down of loaded tubes and placing of empty tubes onto the one first mandrel unit to take place at least substantially at the same time.

DRAWINGS

Further advantages can be gathered from the following description of the drawings. An exemplary embodiment of the invention is illustrated in the drawings. The drawings, the description and the claims contain numerous features in combination. A person skilled in the art will expediently also consider the features individually and combine them to form appropriate further combinations.

DESCRIPTION OF THE EXEMPLARY EMBODIMENTS

Figure 1:
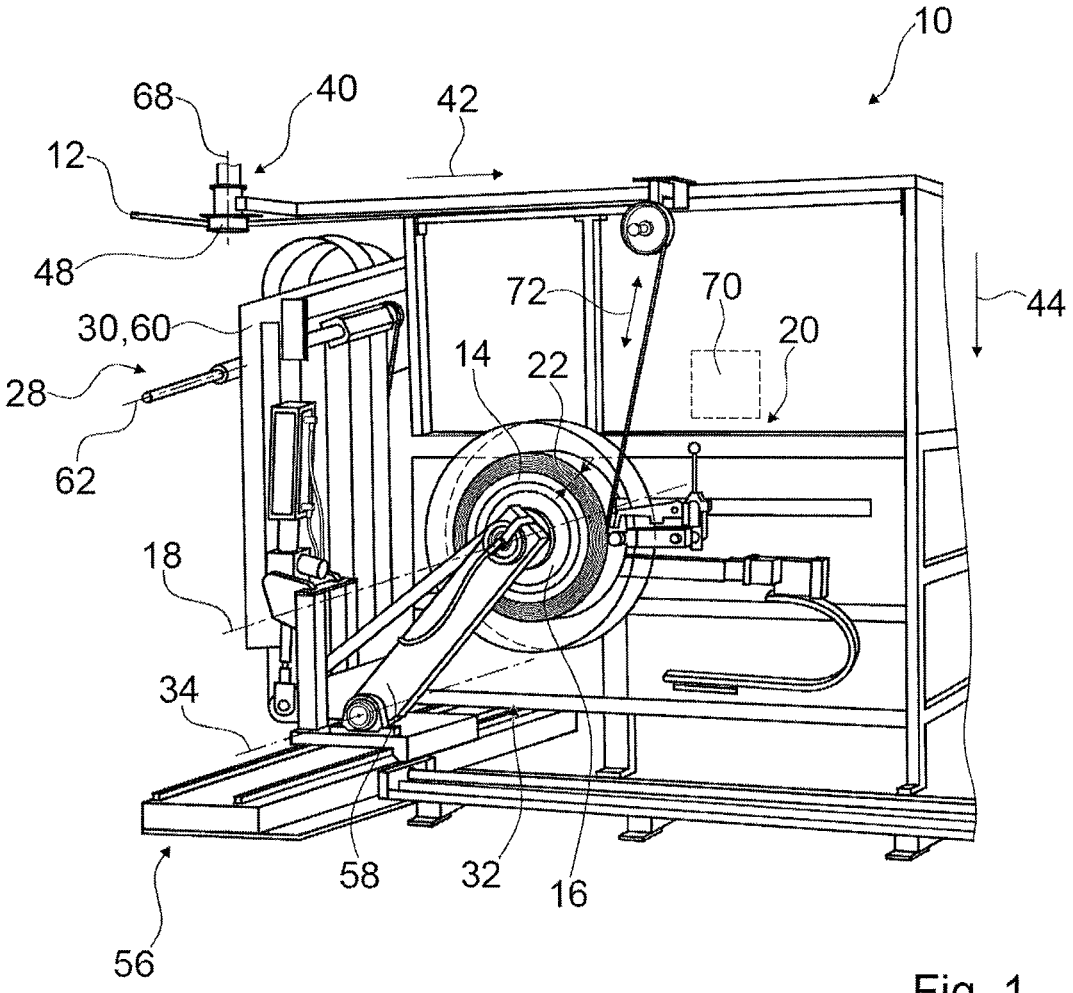
FIG. 1 shows a winding device during a winding-up operation.

FIG. 1 shows a winding device 10 for winding up a strip-form material to be wound 12 onto an exchangeable tube 14. However, the use of other materials to be wound having a geometry that differs from a strip form likewise conceivable. In order to wind up the material to be wound 12, the tube 14 is driven in rotation about a winding axis 18 by means of a winding mandrel 16.

During the winding-up operation, a mass of the material to be wound 12 that has already been wound up onto the tube 14 is continuously determined. Instead of continuous determination, time-discrete recording, in which the time intervals between individual recording times should be selected depending on a winding speed and/or an overall duration of a winding-up operation, would also be conceivable. For this purpose, the winding device 10 has a mass-determining unit 20, which records a mass characteristic of the already wound-up material to be wound 12. The mass characteristic may be the mass of the already wound-up material to be wound 12 itself, which is recorded for example directly by a mass sensor. Preferably, however, the mass characteristic is a characteristic by way of which the mass of the already wound-up material to be wound 12 is recordable indirectly.

Thus, for example during the winding-up operation, an overall thickness 22 of the material to be wound 12 that has already been wound up on the tube 14 can be recorded by the mass-determining unit 20. This may take place for example such that the mass-determining unit 20 undergoes a change in position on account of the overall thickness 22 increasing during the winding-up operation, wherein a displacement travel of the mass-determining unit 20 corresponds to the overall thickness 22 of the already wound-up material to be wound 12. When the width of the tube 14 and the density of the material to be wound 12 are known, the mass of the already wound-up material to be wound 12 is calculable exactly on the basis of the recorded overall thickness 22 of the material to be wound 12 that has already been wound up. Alternatively, it would likewise be conceivable for a length of an already wound-up material to be wound to be recorded by a mass-determining unit. When the cross-sectional geometry and density of a material to be wound is known, the mass of the already wound-up material to be wound is calculable on the basis of the recorded length. Furthermore, it is likewise possible to weigh a tube loaded with a predetermined quantity of a material to be wound and to use the recorded values as reference values for determining the mass during a winding-up operation.

Furthermore, the winding device 10 has an open-loop and/or closed-loop control unit 70, which is illustrated merely in an indicated manner here. The open-loop and/or closed-loop control unit 70 is provided to set, during a winding-up operation, a tension 72 that acts in the material to be wound 12 to a fixed value, coordinated in particular with the material to be wound 12, taking into account the mass characteristic. To this end, the open-loop and/or closed-loop control unit 70 acquires the at least one mass characteristic recorded by the at least one mass-determining unit 20 and evaluates said mass characteristic, in particular on the basis of parameters and/or calculation formulas stored in the open-loop and/or closed-loop control unit 70. The tension 72 is set by the open-loop and/or closed-loop control unit 70 during a winding-up operation by way of a change in the torque of the winding mandrel 16 and/or of a drive unit (not illustrated here) which is provided to set the winding mandrel 16 into a rotary movement. In the process, the open-loop and/or closed-loop control unit 70 increases the torque as the mass and/or the mass characteristic increases. The increase in the torque takes place proportionally to an increase in the mass characteristic and/or of the mass, with the result that the tension 72 is kept constant throughout the winding-up operation.

Figure 2:
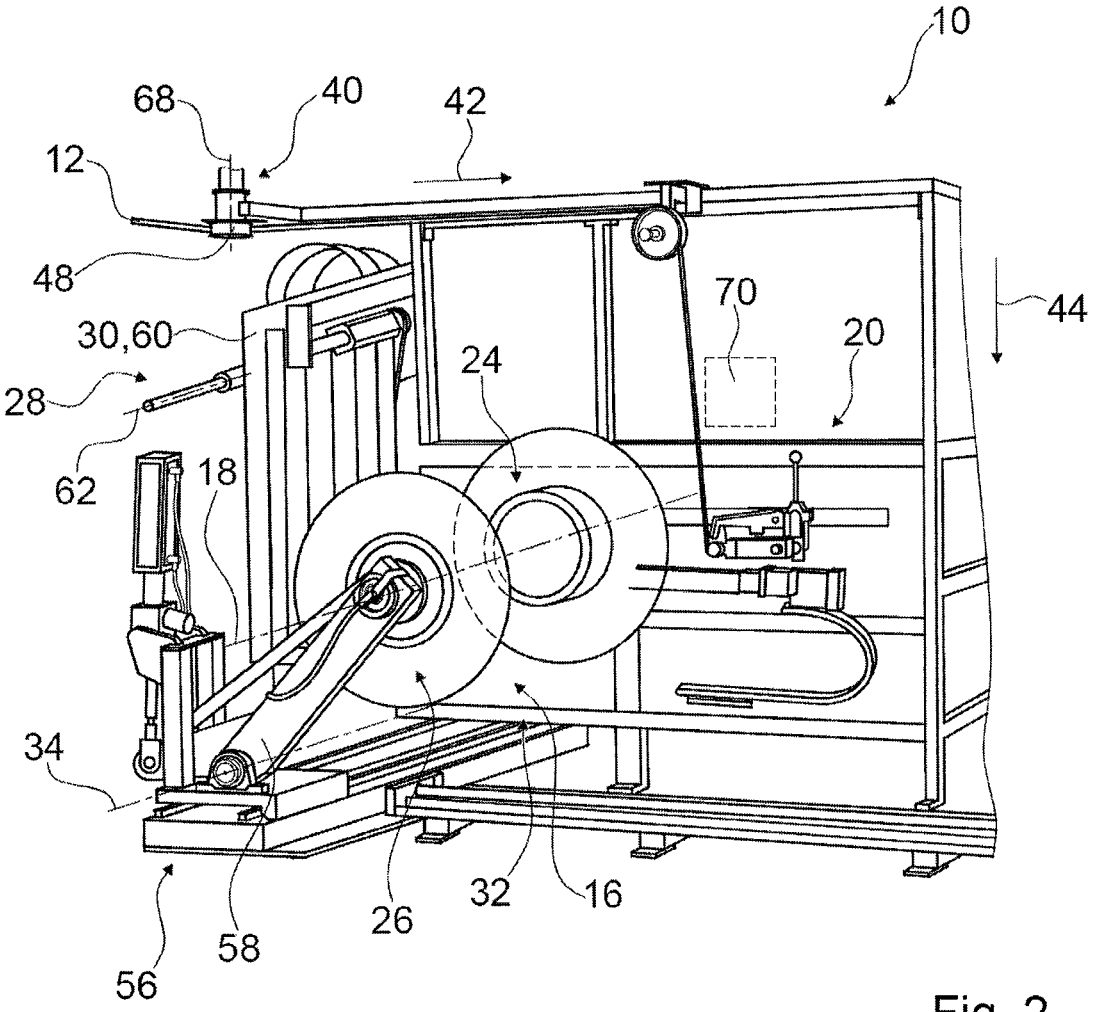
FIG. 2 shows the winding device from FIG. 1 with a divided winding mandrel.

FIG. 2 shows the winding device 10 from FIG. 1 between two winding-up operations. It can be seen that the winding mandrel 16 has a first mandrel unit 24 and a second mandrel unit 26. The first mandrel unit 24 and the second mandrel unit 26 are designed such that they are introducible from opposite sides into a tube 14 onto which the material to be wound 12 is provided to be wound up. Preferably, the first mandrel unit 24 and the second mandrel unit 26 each have a plurality of clamping jaws (not illustrated here) by way of which a force-fitting connection with an inner surface of the tube 14 is producible.

In order to insert and/or remove the tube 14, a distance between the first mandrel unit 24 and the second mandrel unit 26 is variable. To this end, the second mandrel unit 26 is on an arm 58 mounted on rails 56, such that the second mandrel unit 26 is displaceable parallel to and/or along the winding axis 18. In addition, the arm 58 is mounted so as to be pivotable about an axis 34 extending parallel to the winding axis 18, with the result that a distance between the second mandrel unit 26 and the first mandrel unit 24 is also variable perpendicularly to the winding axis 18. If the first mandrel unit 24 and the second mandrel unit 26 have been introduced fully into a tube, these together form the winding mandrel 16. During a winding-up operation, the first mandrel unit 24 and the second mandrel unit 26 are in a state in which they have been introduced fully into the tube 14. In this case, the first mandrel unit 24 and the second mandrel unit 26 are designed such that, in the state in which they have been introduced fully into the tube, there is a distance of 10 mm between an end side of the first mandrel unit 24 and an end side of the second mandrel unit 26. Depending on a width of a respectively used tube, a distance between a first mandrel unit and a second mandrel unit can vary, although the distance is never zero.

The first mandrel unit 24 is operatively connected to a drive unit (not illustrated). The drive unit is in the form for example of an electric motor. During a winding-up operation, the drive unit sets the first mandrel unit 24 into a rotary movement about the winding axis 18. The rotary movement is transmitted via the tube 14 to the second mandrel unit 26, with the result that the second mandrel unit 26 rotates about the winding axis 18 in the same direction and at the same speed as the first mandrel unit 24.

Furthermore, the winding device 10 comprises a tube-changing unit 28 which feeds the tubes 14 to the first mandrel unit 24 and transports said tubes 14 away from the first mandrel unit 24 following the completion of the winding-up operation. In this case, the tube-changing unit 28 has a first handling unit 30 and a second handling unit 32. The first handling unit 30 feeds empty tubes 14 to the first mandrel unit 24. To this end, the first handling unit 30 is in the form of an arm 60 which is movable parallel to the winding axis 18 and is pivotable about an axis 62 extending parallel to the winding axis 18. This makes it possible for the first handling unit 30 to place empty tubes 14 on the first mandrel unit 24.

The second handling unit 32 is formed from the second mandrel unit 26 and the arm 58, on which the second mandrel unit 26 is mounted. The second handling unit 32 removes the loaded tube 14 from the first mandrel unit 26 following the completion of a winding-up operation. In this case, the second mandrel unit 26 transmits a tensile force produced by a movement of the arm 58 along the rails 56 to the loaded tube 14 to be removed, with the result that the latter is removed from the first mandrel unit 24. The loaded tube 14 removed from the first mandrel unit 24 is set down for further transport by way of a pivoting movement of the arm 58 about the axis 34 extending parallel to the winding axis 18.

Figure 3:
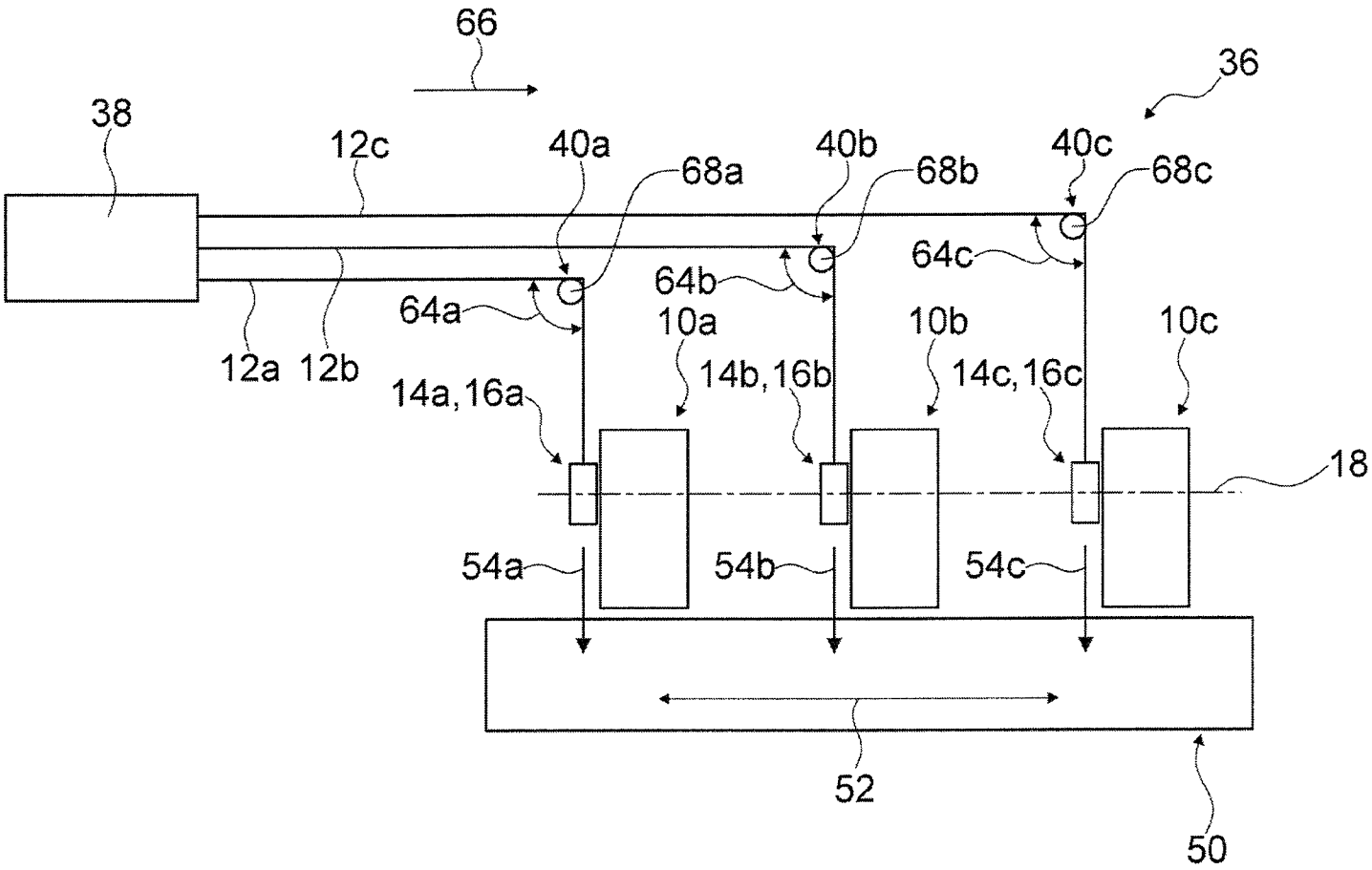
FIG. 3 shows a schematic plan view of a winding system having three winding devices and one feed device.

FIG. 3 shows a schematic plan view of a winding system 36. The winding system 36 comprises a feed device 38 and for example three winding devices 10*a*, 10*b*, 10*c*, as are shown in detail in FIGS. 1 and 2. The feed device 38 is for example an extruder which produces a material to be wound 12*a*, 12*b*, 12*c*, or a device in which a store of the material to be wound 12*a*, 12*b*, 12*c* is available. The winding devices 10*a*, 10*b*, 10*c* are oriented parallel to one another. The winding axis 18 has an identical orientation for the three winding devices 10*a*, 10*b*, 10*c*.

Each winding device 10*a*, 10*b*, 10*c* is assigned a deflecting unit 40*a*, 40*b*, 40*c* which deflects the material to be wound 12*a*, 12*b*, 12*c* coming from the feed device 38 at an angle 64*a*, 64*b*, 64*c* of 90° about an axis 68*a*, 68*b*, 68*c* which extends parallel to the direction of gravitational force 44, as said material to be wound 12*a*, 12*b*, 12*c* travels to the winding devices 10*a*, 10*b*, 10*c*. Alternatively, a deflection of a material to be wound about an axis which extends parallel to the direction of gravitational force can also take place about an angle of less than 90°, although the angle is at least 10°. In this case, the deflection takes place in a direction 42 which extends perpendicularly to the direction of gravitational force 44 (cf. FIGS. 1 and 2). Depending on the particular application case, a deflection can also take place in a direction which encloses an angle of less than 90° with the direction of gravitational force, although the angle is at least 30°. A feed direction 66 of the material to be wound 12*a*, 12*b*, 12*c* extends here between the feed unit 38 and the deflecting units 40*a*, 40*b*, 40*c* for example parallel to the winding axis 18 of the winding devices 10*a*, 10*b*, 10*c*. The deflecting units 40*a*, 40*b*, 40*c* each comprise a deflecting roller 48 having a lateral guide (not illustrated in more detail) which prevents a material to be wound 12*a*, 12*b*, 12*c* from jumping down from the particular deflecting roller 48. During deflection by the deflecting unit 40*a*, 40*b*, 40*c*, the material to be wound 12*a*, 12*b*, 12*c* is rotated first of all from a horizontal orientation to a vertical orientation by the deflecting units 40*a*, 40*b*, 40*c* and returns to a horizontal orientation following deflection, with the result that damage-free deflection of the material to be wound 12*a*, 12*b*, 12*c* is achieved.

A transporting device 50 which transports away loaded tubes 14*a*, 14*b*, 14*c* is arranged downstream of the winding devices 10*a*, 10*b*, 10*c*. A transporting direction 52 of the transporting device 50 extends parallel to the winding axis 18. The loaded tubes 14*a*, 14*b*, 14*c* are in this case transferred to the transporting device 50 by a handling unit 32 of the particular winding device 10*a*, 10*b*, 10*c*. In this case, a transfer direction 54*a*, 54*b*, 54*c* extends perpendicularly to the winding axis 18, with the result that a directed material flow within the winding system 36 is achieved.

The invention claimed is:

1. A winding device for winding up at least one material to be wound onto at least one exchangeable tube, having at least one winding mandrel which is provided to receive the at least one tube in at least one operating state and to drive the at least one tube in rotation about a winding axis, wherein the at least one winding mandrel has a first mandrel unit and at least one second mandrel unit, wherein the mandrel units are introducible from opposite sides into the at least one tube, wherein a distance between the first mandrel unit and the second mandrel unit is variable in a manner parallel and perpendicular to the winding axis.

2. The winding device according to claim 1, wherein the at least one second mandrel unit is drivable via the at least one tube.

3. The winding device according to claim 1, wherein the first mandrel unit and the at least one second mandrel unit are arranged in a manner spaced apart from one another during at least one winding-up operation.

4. The winding device according to claim 1, wherein at least one tube-changing unit is provided to feed the at least one tube to the first mandrel unit.

5. The winding device according to claim 4, wherein the at least one tube-changing unit comprises at least one first handling unit which is provided to place empty tubes on the first mandrel unit.

6. The winding device according to claim 5, wherein the at least one first handling unit and the at least one second handling unit are movable in a parallel manner about the winding axis and are pivotable about an axis parallel to the winding axis.

7. The winding device according to claim 4, wherein the at least one tube-changing unit comprises at least one second handling unit which is provided to remove loaded tubes from the first mandrel unit.

8. The winding device according to claim 7, wherein the at least one second handling unit is formed at least partially in one piece with the at least one second mandrel unit.

9. The winding device according to claim 4, wherein the first handling unit is in the form of an arm which is movable parallel to the winding axis and is pivotable about an axis extending parallel to the winding axis.

10. The winding device according to claim 1, wherein at least one tube-changing unit is provided to feed the at least one tube to the first mandrel unit and to transport said tube away from the first mandrel unit.

11. The winding device according to claim 1, wherein at least one tube-changing unit is provided to transport said tube away from the first mandrel unit.

12. The winding device according to claim 1, wherein the at least one second mandrel unit is displaceable along a straight line, which extends parallel to the winding axis, relative to the one first mandrel unit, and is pivotable relative to the one first mandrel unit, wherein a pivot axis extends parallel to the winding axis.

13. The winding device according to claim 1, further comprising a mass-determining unit for recording a mass characteristic of the already wound-up material.

14. The winding device according to claim 13, further comprising an open-loop and/or closed-loop control unit, wherein the open-loop and/or closed-loop control unit is intended to set, during a winding-up operation, a tension that acts in the material to be wound to a fixed value, coordinated with the material to be wound, taking into account the mass characteristic, wherein the open-loop and/or closed-loop control unit acquires the at least one mass characteristic recorded by the at least one mass-determining unit and evaluates said mass characteristic on the basis of parameters and/or calculation formulas stored in the open-loop and/or closed-loop control unit.

15. The winding device according to claim 1, wherein the second mandrel unit is mounted on an arm, wherein the arm is mounted on rails and is mounted so as to be pivotable about an axis extending parallel to the winding axis, such that the second mandrel unit is displaceable parallel to and along the winding axis.

* * * * *